US008944394B2

(12) United States Patent
Berger

(10) Patent No.: US 8,944,394 B2
(45) Date of Patent: Feb. 3, 2015

(54) HARDWARE FOR MOUNTING GLASS PANELS OR SIMILAR STRUCTURES

(75) Inventor: Joseph D. Berger, Philadelphia, PA (US)

(73) Assignee: Maax Bath Inc. (CA)

( * ) Notice: Subject to any disclaimer, the term of this patent is extended or adjusted under 35 U.S.C. 154(b) by 22 days.

(21) Appl. No.: 13/455,503

(22) Filed: Apr. 25, 2012

(65) Prior Publication Data

US 2012/0204492 A1 Aug. 16, 2012

Related U.S. Application Data

(63) Continuation of application No. 12/571,041, filed on Sep. 30, 2009, now abandoned.

(60) Provisional application No. 61/213,912, filed on Jul. 28, 2009.

(51) Int. Cl.

| | |
|---|---|
| ***E05D 7/06*** | (2006.01) |
| ***A47F 5/08*** | (2006.01) |
| ***A47K 3/00*** | (2006.01) |
| ***E05F 1/06*** | (2006.01) |
| ***E05D 5/02*** | (2006.01) |

(52) U.S. Cl.

CPC ..... *E05F 1/061* (2013.01); *E05D 5/0246* (2013.01); *E05Y 2800/672* (2013.01); *E05Y 2900/114* (2013.01)

USPC ..... 248/231.91; 248/213.1; 16/429; 16/239; 16/240; 16/235; 16/236; 16/237; 16/238; 16/215; 16/218; 16/341; 16/221; 16/242; 16/248; 16/357; 16/362; 4/607; 4/610; 4/596; 4/557

(58) Field of Classification Search

USPC ..... 248/231.91, 213.1; 16/429, 239, 240, 16/235, 236–237, 238, 315, 318, 341, 221, 16/242, 248, 357, 362; 4/607, 610, 596, 4/557

See application file for complete search history.

(56) References Cited

U.S. PATENT DOCUMENTS

| | | | | |
|---|---|---|---|---|
| 2,627,327 | A | 2/1953 | Backman | |
| 3,410,026 | A | 11/1968 | Casebolt | |
| 3,628,845 | A * | 12/1971 | Grimm | 312/309 |

(Continued)

FOREIGN PATENT DOCUMENTS

| | | | |
|---|---|---|---|
| DE | 3638384 | A1 | 5/1988 |
| DE | 19649352 | A1 | 6/1998 |

(Continued)

OTHER PUBLICATIONS

Partial European Search Report for Application No. 10171113.3 dated Aug. 12, 2013.

*Primary Examiner* — Christopher Garft

(74) *Attorney, Agent, or Firm* — Lerner, David, Littenberg, Krumholz & Mentlik, LLP

(57) ABSTRACT

In one embodiment, the present invention includes a hinge for movably connecting a first panel to a second panel, the hinge comprising first and second spaced apart hinge members, each hinge member being connectable to the respective first and second panels; and a connector located between the hinge members, the connector having a pin member which connects the hinge members together to permit selective movement of the first panel relative to the second panel about multiple axes.

15 Claims, 9 Drawing Sheets

(56) References Cited

U.S. PATENT DOCUMENTS

| | | | | |
|---|---|---|---|---|
| 4,375,736 | A | 3/1983 | Teckchandani | |
| 4,453,346 | A | 6/1984 | Powell et al. | |
| 4,606,084 | A | 8/1986 | Baus | |
| 4,633,614 | A | 1/1987 | Van Weelden | |
| 4,697,306 | A | 10/1987 | Rhodes | |
| 4,785,498 | A | 11/1988 | Brotschi | |
| 4,897,889 | A | 2/1990 | Baus | |
| 5,205,072 | A * | 4/1993 | Eutebach | 49/381 |
| 5,848,446 | A | 12/1998 | DeBraal | |
| 5,893,181 | A * | 4/1999 | Moncaster | 4/557 |
| 5,908,064 | A * | 6/1999 | Bruce | 160/202 |
| 6,035,460 | A | 3/2000 | Borter | |
| 6,148,451 | A | 11/2000 | DeBraal et al. | |
| 6,618,871 | B2 * | 9/2003 | Kopacz et al. | 4/607 |
| 6,766,561 | B1 | 7/2004 | Cheng | |
| 6,817,144 | B1 | 11/2004 | Tavivian | |
| 7,013,531 | B2 | 3/2006 | Jackson | |
| 7,065,806 | B2 | 6/2006 | Reichel et al. | |
| 7,111,363 | B2 | 9/2006 | Lee et al. | |
| 7,240,400 | B2 * | 7/2007 | Bonham | 16/238 |
| 7,516,518 | B2 * | 4/2009 | Kiefer | 16/252 |
| 2003/0019030 | A1 * | 1/2003 | Kopacz et al. | 4/607 |
| 2005/0183238 | A1 * | 8/2005 | McCue et al. | 16/236 |
| 2006/0242792 | A1 | 11/2006 | Kienle | |
| 2009/0188082 | A1 | 7/2009 | Huang | |

FOREIGN PATENT DOCUMENTS

| | | | |
|---|---|---|---|
| DE | 19650604 | A1 | 6/1998 |
| DE | 19826623 | A1 | 12/1999 |
| DE | 20218620 | U1 | 4/2003 |
| DE | 20302369 | U1 | 5/2003 |
| DE | 20302400 | U1 | 5/2003 |
| DE | 20318958 | U1 | 4/2004 |
| DE | 202004004258 | U1 | 10/2004 |
| DE | 202004010300 | U1 | 10/2004 |
| DE | 202005010512 | U1 | 9/2005 |
| DE | 102004034774 | A1 | 2/2006 |
| EP | 0637669 | A1 | 2/1995 |
| EP | 0777027 | A1 | 6/1997 |
| EP | 1013210 | A2 | 6/2000 |
| EP | 1243214 | A2 | 9/2002 |
| EP | 1319359 | A2 | 6/2003 |
| EP | 1457629 | A1 | 9/2004 |
| FR | 2888873 | A3 | 1/2007 |
| GB | 2209794 | A | 5/1989 |
| GB | 2247278 | A | 2/1992 |
| GB | 2449659 | A | 12/2008 |
| WO | 2004083579 | A1 | 9/2004 |

* cited by examiner

HARDWARE FOR MOUNTING GLASS PANELS OR SIMILAR STRUCTURES

CROSS REFERENCE

The present application is a continuation of U.S. patent application Ser. No. 12/571,041, filed on Sep. 30, 2009, which claims the benefit of the filing date of U.S. Provisional Application No. 61/213,912 filed on Jul. 28, 2009, the disclosure of which are hereby incorporated by reference herein.

TECHNICAL FIELD

The present invention is directed to hardware for securing panels made of glass or similar material, of the type typically used in bathroom installations. More particularly, the invention encompasses a hinge structure allowing for an easier adjustment between a pivoting panel and fixed one. The invention also extends to a clamping structure for mounting a panel to wall.

SUMMARY

In a broad aspect the invention provides a hinge for pivotally connecting a first panel to a second panel. The hinge has a first hinge member for connection to the first panel and a second hinge member for connection to the second panel. The hinge has a connector between the first hinge member and the second hinge member, the connector allowing the first hinge member to pivot with relation to the second hinge member. The connector is mounted in a track formed in the first hinge member and is selectively movable therein to vary a position of the first hinge member with relation to the second hinge member.

In another broad aspect, the invention provides a moveable panel structure having a first panel, a second panel and a hinge for mounting the panels to one another such that one panel can pivot with relation to the other about an imaginary axis. The hinge has a first hinge member mounted to the first panel and a second hinge member mounted to the second panel. The first hinge member is selectively moveable relative to the second hinge member along a direction that is generally transverse to the imaginary axis.

A clamping arrangement for mounting a panel to a wall, the clamping arrangement having a base component to be secured to the wall, the base component including a support leg projecting generally perpendicularly from the wall. The clamping arrangement also has a clamping member pivotally mounted to the base component, the clamping member including a clamping leg projecting from the clamping member and extending along the support leg to define with the support leg a seat for receiving a panel edge. A fastener is mounted on the clamping member for causing a pivotal movement of the clamping member to urge the clamping leg toward support leg.

BRIEF DESCRIPTION OF THE DRAWINGS

A detailed description of examples of implementation of the present invention is provided hereinbelow with reference to the following drawings, in which.

Figure 1:
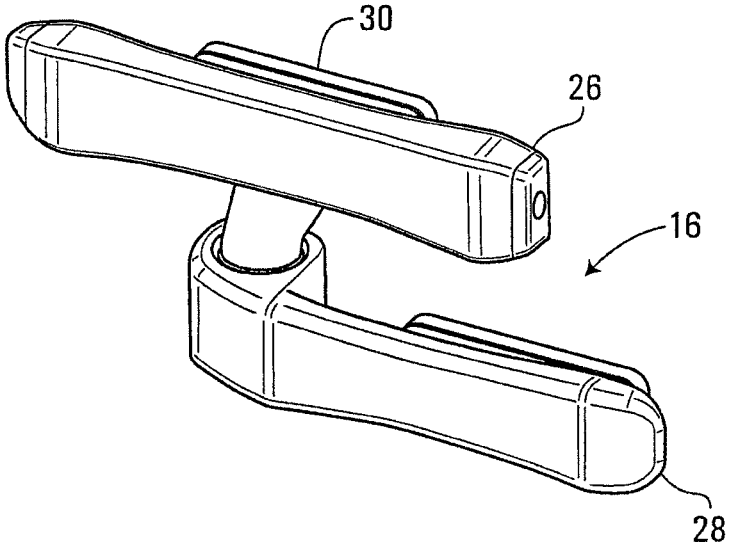
FIG. 1 is a perspective view from the front of a hinge for pivotally mounting two glass panels according to a non-limiting example of implementation of the invention.
Figure 2:
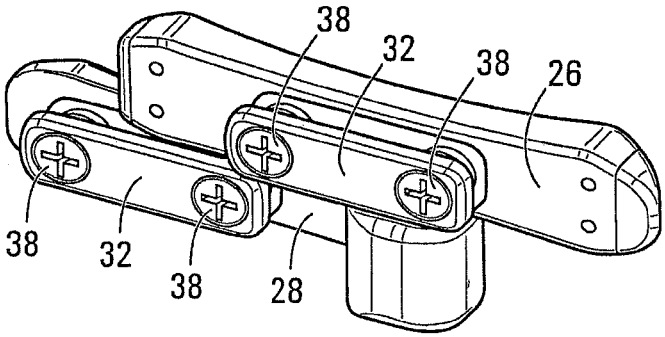
FIG. 2 is perspective view from the back of the hinge shown in FIG. 1, some components being omitted for clarity.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF ILLUSTRATIVE EMBODIMENTS

FIG. 1 is a perspective view of a hinge suitable for pivotally mounting panels made of glass or any other suitable material to one another. More specifically, the hinge can be used for pivotally mounting a glass panel that constitutes the door of a shower stall.

Figure 3:
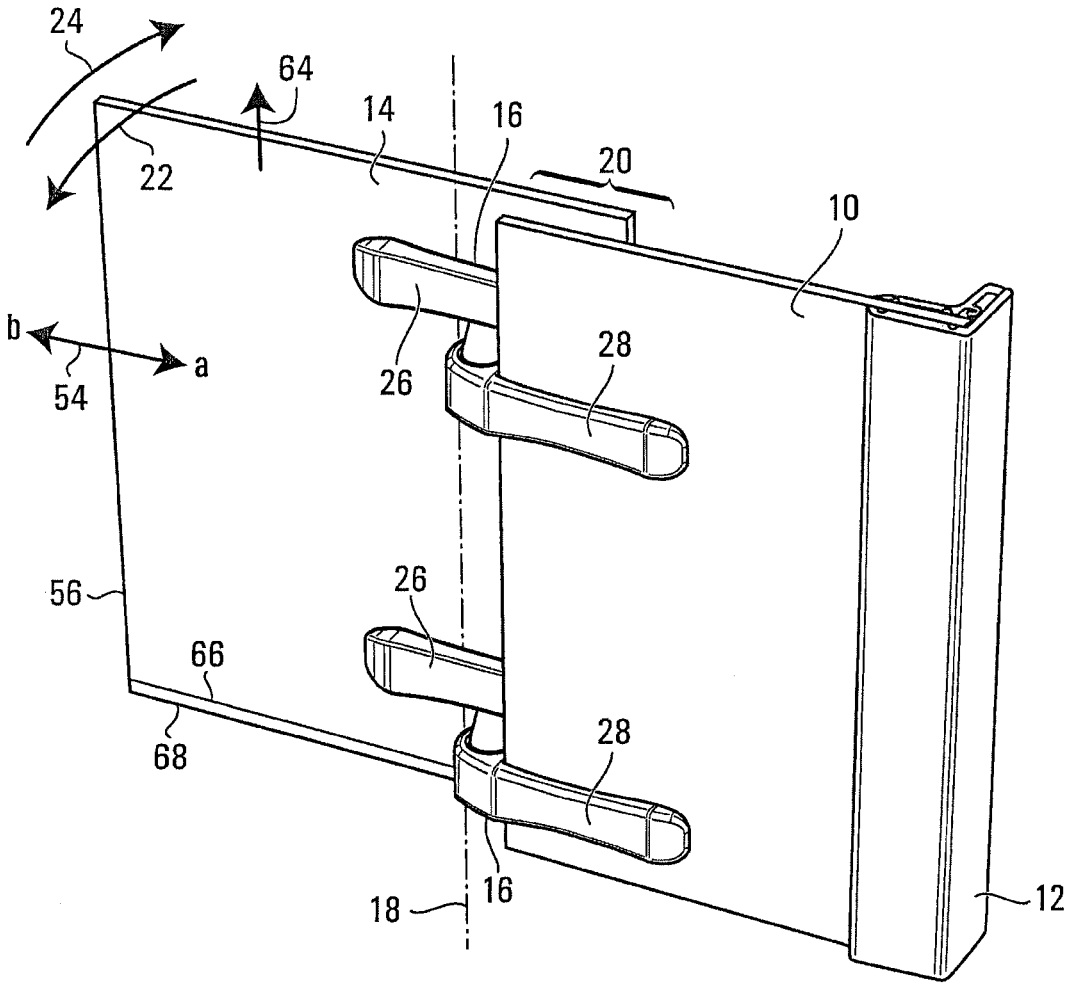
FIG. 3 is a fragmentary perspective view of two glass panels pivotally mounted to one another using the hinge arrangement shown in FIGS. 1 and 2.

FIG. 3 is a fragmentary perspective view of an arrangement of glass panels that use the hinge according to the present invention. In the example shown, the arrangement of panels includes a fixed panel that is mounted to a wall via the clamping structure. The clamping structure will be described in greater detail later. The panel 10 is secured to the wall (not shown) in such a way that the panel 10 is generally perpendicular to the wall.

A movable panel 14 is pivotally connected to the fixed panel 10 by a pair of hinges 16. In the example, two hinges 16 are shown, but more than two can be used, especially if the movable panel 14 is heavy and requires more support. The hinges 16 allow the movable panel 14 to pivot about a generally vertical axis 18 in order to open or close the door of the shower stall.

The hinges 16 mount to the respective panels 14 and 10 in such a way that the meeting edge portions of the panels overlap one another in the area 20. During the pivotal movement imparted to the moving panel 14 to open the door, the panel 14 pivots in the direction 22. The door closes when the panel 14 moves in the opposite direction identified by the arrow 24. The relative position in which the panels 10 and 14 are shown corresponds to a position in which the door of the shower stall is closed. In that position, the hinges 16 acts as abutments to prevent further movement of the moveable panel 14 along the direction 24, which if allowed could cause the panels 10, 14 to interfere with one another in the area of overlap 20. Note that this abutment feature is optional and the invention is not limited to this particular characteristic. Embodiments are possible where the abutment feature is not implemented.

Referring back to FIG. 1, the hinge 16 includes a pair of hinge members 26 and 28 pivotally mounted to one another.

Figure 4:
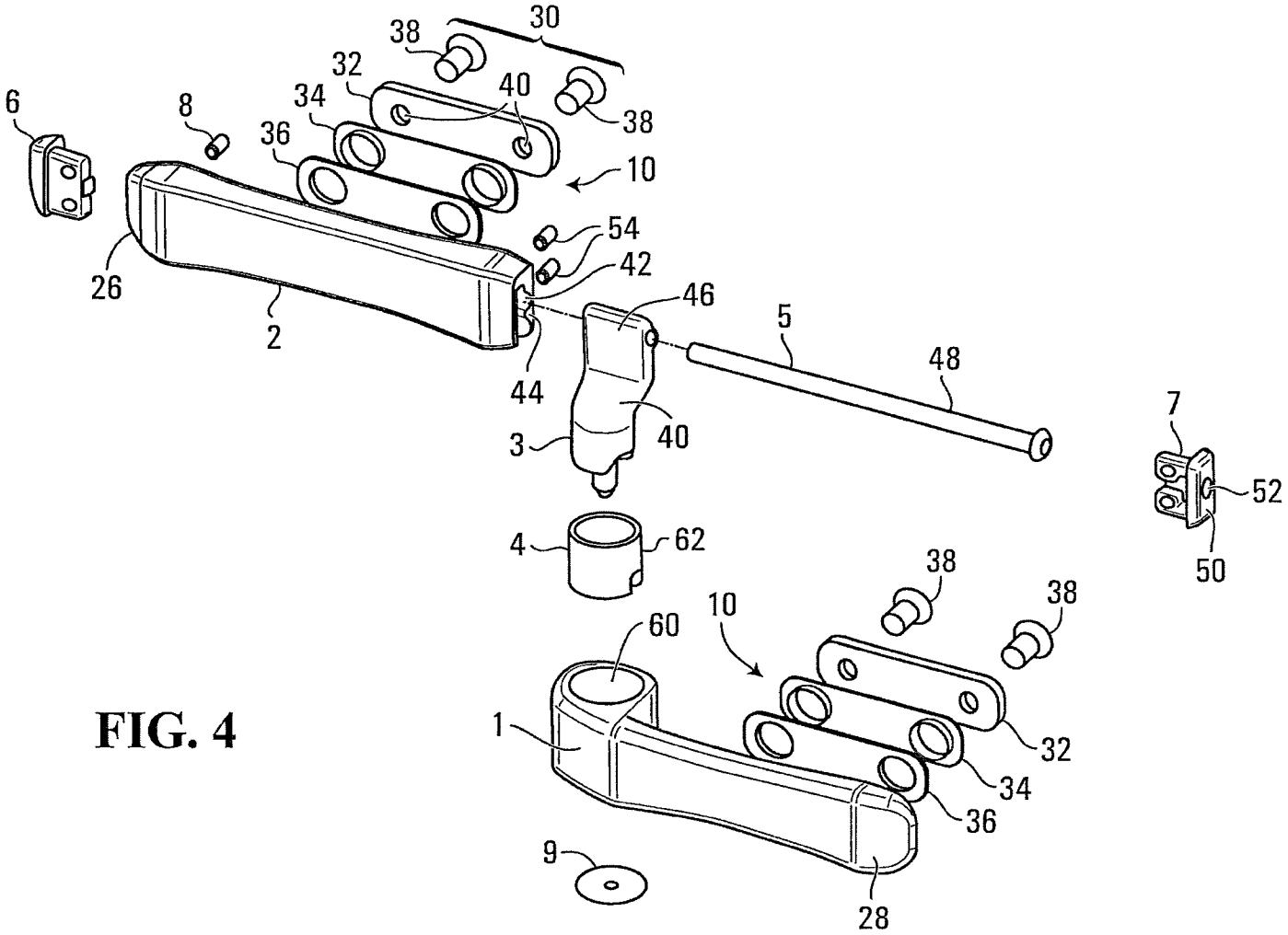
FIG. 4 is an exploded view of the hinge shown in FIG. 1.

In the arrangement shown in FIG. 3, the hinge member 26 attaches to the moving panel 14 while the hinge member 28 attaches to the fixed panel 10. The hinge member 26 mounts to the glass material by a clamp structure 30. The clamp structure 30 is best shown in FIG. 4 and it includes a clamping plate 32, a pair of liners 34 and 36 made of compliant material such as rubber of similar polymeric materials and a pair of fastening screws 38. To secure the hinge member 26 to the moveable panel 14 a pair of holes are drilled in the glass panel 14 to register with the openings 40 in the clamping plate 32. The clamping plate 32 and the liner 34 is placed against one face of the glass panel 14 while the hinge member 26 and the other liner 36 are placed against the opposite face of the glass panel 14. The screws 38 are inserted in the drilled holes and fastened in respective threaded apertures (not shown in FIG. 3) in the hinge member 26. In this fashion, the hinge member 26 is securely fastened on the glass panel 14. The hinge member 28 attaches to the fixed panel 10 in a similar fashion. For clarity and completeness the attachment components of the hinge member 28 are identified using the same reference numerals as those in connection with hinge member 26.

A connector attaches the hinge member 26 to the hinge member 28 while allowing the hinge members 26, 28 to pivot one with respect to the other. The connector includes a pivot pin 40 mounted on the hinge member 26 which rests onto the hinge member 28 and at the same time allows a relative pivotal movement between the two hinge members 26, 28. The pivot pin 40 slidingly mounts in a track 42 extending longitudinally into hinge member 26. The track 42 opens at 44 and can receive the upper end portion 46 of the pivot pin 40. The upper end portion 46 is geometrically configured to match the cross-sectional profile of the track 42 such as to allow the pivot pin 40 to slidingly move in the track 42. The sliding movement allows positioning the pivot pin 40 at any desired position along the length of the hinge member 26. A screw 48 is threaded into the upper end portion 46 and it is received longitudinally into the track 42. A cap 50 made of plastic or any other suitable material closes the track opening 44 in order to keep the screw 48 captive in the track 42. The cap has an aperture 52 that lines up with the head of the screw 48 and allows receiving the head of a tool, such as a screw driver in order to turn the screw 48. The cap 50 mounts in the opening 44 of the track 42 and it is secured therein with a pair of Allen screws 54 or with any other suitable fasteners.

The hinge member 26 is assembled by threading the screw 48 into the upper end portion 46 and then the upper end portion 46 is inserted into the track 42 via the entryway 44. The upper end portion slides into the track 42 until the extremity of the screw 48 abuts against the bottom of the track 42. The cap 50 is then placed in the track 42 to close the entryway 44 and secured in place via the Allen screws 54.

The screw 48 allows locating the pivot pin 40 at any desirable position in the track 42. To adjust the position of the pivot pin 40, any appropriate tool is used to turn the screw 48 and as a result cause a translational movement of the upper end portion 46 within the track 42.

This arrangement is such that the position of the hinge member 26 can be easily adjusted with relation to the hinge member 28. Referring back to FIG. 3, when the screw 48 of the upper hinge 16 is turned, the edge of the glass panel 14 will be caused to move along the axis 54, the direction of movement being determined by the direction in which the screw 48 is turned. The axis 54 is generally perpendicular to the imaginary pivot axis between the hinge members 26, 28. More specifically, a clockwise rotation of the screw will cause the hinge member 26 to move toward the hinge member 28, causing the edge of the panel 14 to move in the direction 54*a*. An opposite movement is obtained when the screw 48 is turned in the counterclockwise direction.

It is to be noted that since the upper and lower hinges 16 are independent from one another, they can be independently adjusted such as to position the corresponding edges of the panel 14 in the desired position. This adjustability is very useful when it is desired to position the edge 56 of the panel 14 very close to an adjoining panel or structure (not shown in the drawings). Accordingly, the moveable panel 14 does not need to be cut at a very precise panel width in order to achieve a tight and visually pleasant fit with the structure adjoining the edge 56. In order to locate the edge 56 close to the adjoining structure, the panel 14 is hung on the fixed panel 10 with the hinges 16 adjusted independently in order to locate the edge 56 as close as desired to the adjoining structure. It is to be noted that such adjustability is possible since the meeting edges of the panels 14 and 10 do not abut; rather they overlap to permit a relative degree of movement.

Referring back to FIG. 4, the connector between the hinge member 26 and the hinge member 28 is provided with a circular cavity 60, mounted on the hinge member 28, designed to receive a pivot pin bushing 62, which in turn engages the pivot pin 40. The arrangement is such that during the pivotal movement of the moveable panel 14 with respect to the fixed panel 10 the moveable panel 14 pivots and at the same time moves vertically. The upward movement is shown by the arrow 64 in FIG. 3. This characteristic simplifies the construction of the shower stall allowing eliminating the traditional drip channel that is placed immediately below the lower edge 66 of the moveable panel 14. The drip channel (not shown) is usually an aluminum extrusion that interacts with the seal 68 (positioned along the lower edge 66) when the moveable panel 14 is in a closed position such as to prevent water from leaking outside the shower stall under the lower edge 66 of the moveable panel 14.

When the moveable panel 14 is in a closed position, the lower edge 66 of the moveable panel and the seal 68 are positioned such that they are in firm contact with the shower stall floor. Thus, when the movable panel 14 is in a closed position, the seal 68 which is pressed against the floor creates a water tight joint. As the moveable panel 14 is opened by pivoting outwardly, the upward movement imparted to the panel 14 raises the panel 14 up and disengages the seal 68 from the floor. The moveable panel 14 is then free to continue pivoting unimpeded since the seal 68 is disengaged from the floor.

The upward motion of the moveable panel 14 is achieved by creating an interaction between the pivot pin bushing 62 and the pivot pin 40. The interaction is such that as the two components pivot one with respect to the other (during the door opening motion) they are also vertically pushed away from one another along the pivot axis of connector, which produces the vertical motion of the panel 14.

Figure 8:
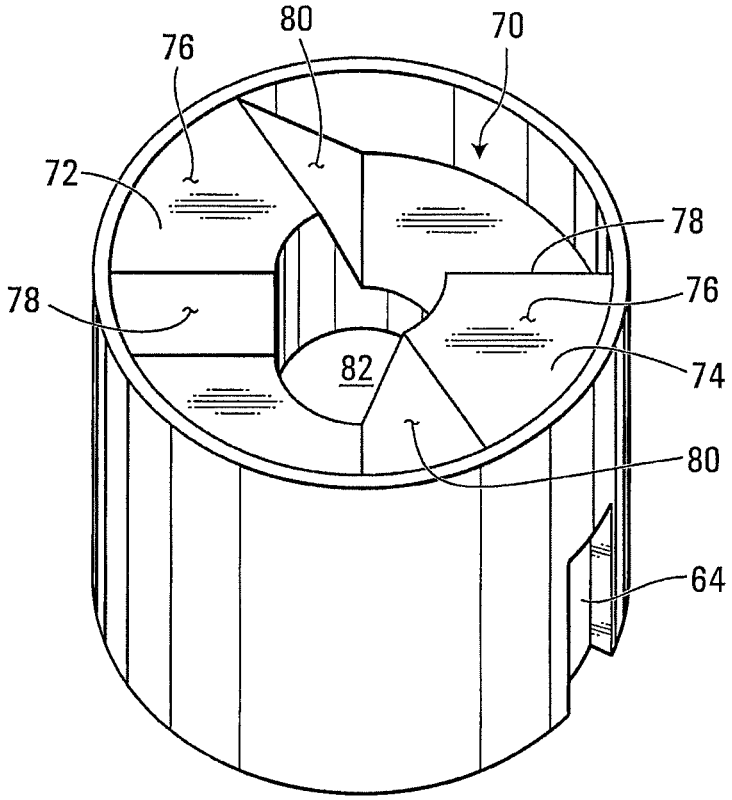
FIG. 8 is a perspective view of a pivot pin bushing of the hinge shown in FIG. 1.
Figure 9:
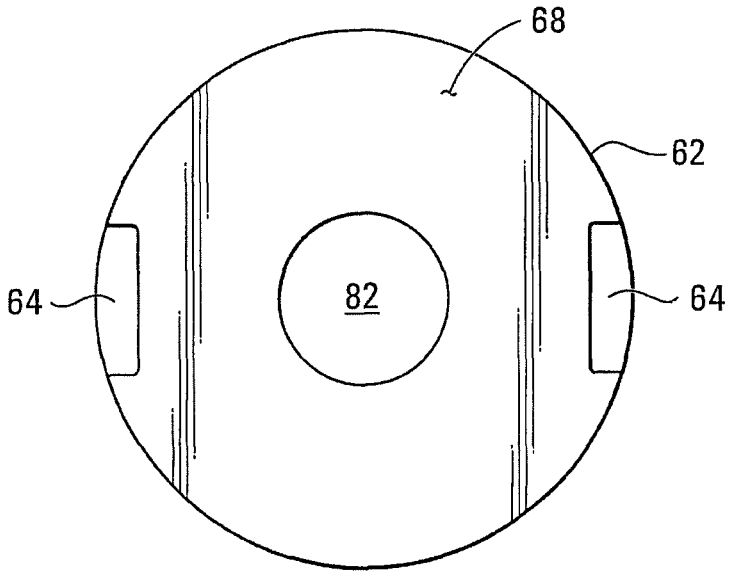
FIG. 9 is a bottom plan view of the pivot pin bushing of the hinge shown in FIG. 1.
Figure 10:
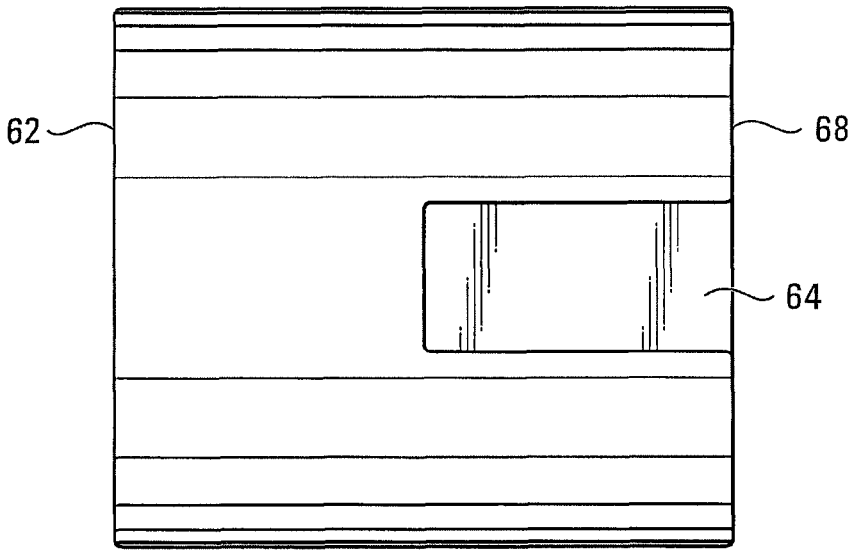
FIG. 10 is a side elevational view of the pivot pin bushing of the hinge shown in FIG. 1.

FIGS. 8, 9 and 10 illustrate the structure of the pivot pin bushing 62. The pivot pin bushing 62 is made of plastic or any other suitable material. It has a generally circular configuration to fit in the circular cavity 60. To prevent the bushing 62 from pivoting in the cavity 60 it is locked therein against angular movement by a pair of projections (not shown in the drawings) in the cavity 60 that engage corresponding recesses 64 formed on the pivot pin bushing 62. Note that the recesses 64 open at the extremity 68 of the pivot pin bushing 62 such that during the insertion of the pivot pin bushing 62 into the cavity 60 the projections slide into the respective recesses 64. The recesses 64 tightly engage the projections in order to limit free play as much as possible.

With specific reference to FIG. 8, the pivot pin bushing 62 is provided with a recess 70 which is opposite the extremity 68 and which receives the pivot pin 40. The recess 70 includes a pair of projections 72 and 74 that are diametrically opposed to one another. Each projection 72, 74 is provided with three functional surfaces. The first surface 76 is a top surface and it is generally horizontal. The second surface 78 is a generally vertical surface and it provides abutment functions, as it will be described below. The third surface 80 is a ramp surface and it is opposite to the abutment surface 78. The ramp surface 80 is a generally sloping surface that connects the top surface 76 with the bottom of the recess 70.

The pivot pin bushing 62 also has a through aperture 82, used for alignment purposes, as it will be discussed below.

Figure 11:
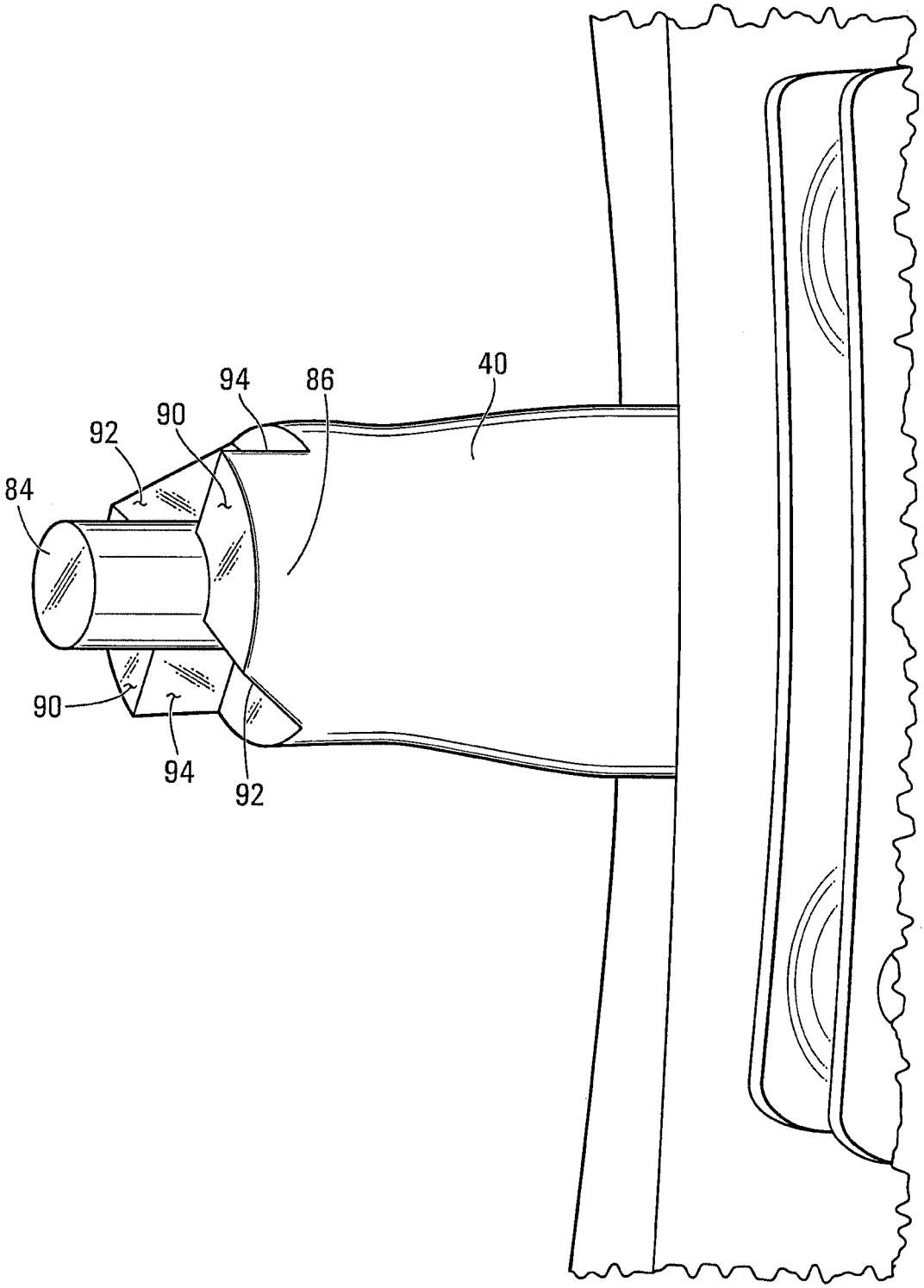
FIG. 11 is an enlarged side view of the pivot pin of the hinge shown in FIG. 1.

FIG. 11 illustrates in greater detail the portion of the pivot pin 40 that fit into the pivot pin bushing 62. Generally, the structure of the pivot pin is the mirror image of the recess 70. When the two components are assembled, they are intended to dovetail with one another. More specifically, the pivot pin 40 is provided with a central generally cylindrical projection 84 which has dimensions such as to fit with little free play into the aperture 82. The pivot pin 40 also has two generally opposite projections 86 and 88, similar to the projections 72 and 74 in terms of structure. The projections 86 and 88 are provided with a pair of top bearing surfaces 90, ramp surfaces 92 and vertical abutment surfaces 94.

When the pivot pin 40 is mounted into the pivot pin bushing 62, the projections 88 and 86 enter the recess 70 and fit between the projections 72 and 74. The bearing surfaces 90 engage the bottom of the recess 70 and the projection 84 is also received in the aperture 82. This position corresponds to the position of the moveable panel 14 shown in FIG. 3, namely the closed position. As the moveable panel 14 pivots toward the opened position, the ramp surfaces 80 and 92 slidingly engage one another and cause the pivot pin 40 to rise out of the pivot pin bushing 62. This relative separation movement produces an upward displacement of the moveable panel 14, which as discussed previously causes the seal 68 to disengage from floor of the shower stall. The relative outward motion between the pivot pin 40 and the pivot pin bushing 62 will continue until the bearing surfaces 90 engage the top surfaces 76 at which point the upward motion will cease and only a pivotal movement will be produced.

As the moveable panel 14 is moved back such as to close the door, the reverse sequence of events takes place. The bearing surfaces 90 disengage from the top surfaces 76 and at that point contact between the pivot pin 40 and the pivot pin bushing 62 occurs at the level of the ramp surfaces 80 and 92. The ramp surfaces 80 and 92 interact and allow the pivot pin 40 to retract into the pivot pin bushing 62 in order to create a descending movement of the moveable panel 14 as it pivots toward the closed position. The cycle terminates as the projections 86 and 88 are fully located between the projections 72 and 74. Any further pivotal movement will not be possible by virtue of the abutment surfaces 94 and 78 engaging one another. Since those surfaces are vertical they act as a stopping device to prevent the moveable panel 14 from being moved beyond the closed position shown in FIG. 3.

Figure 5:
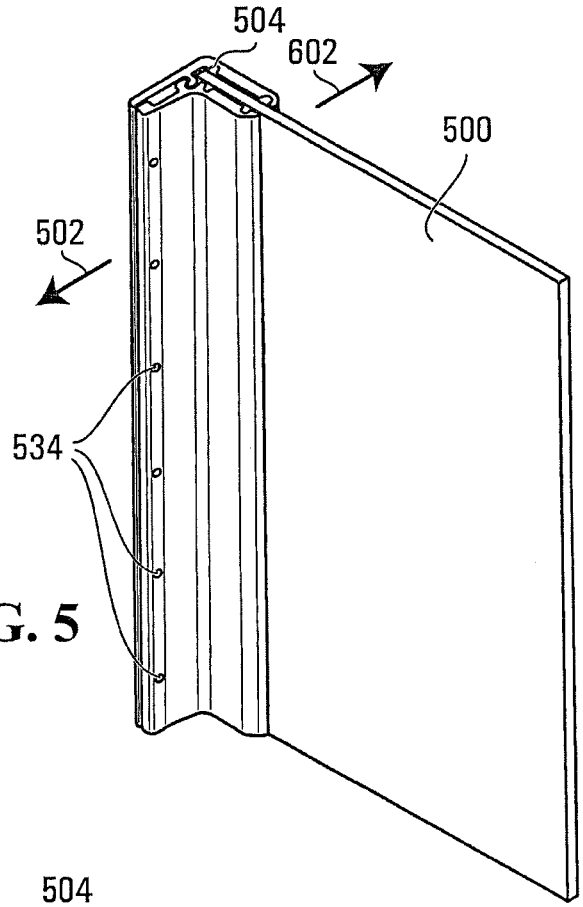
FIG. 5 is a perspective view of a glass panel and a clamping structure for mounting the glass panel to a wall, the perspective view being taken from one side of the panel.
Figure 6:
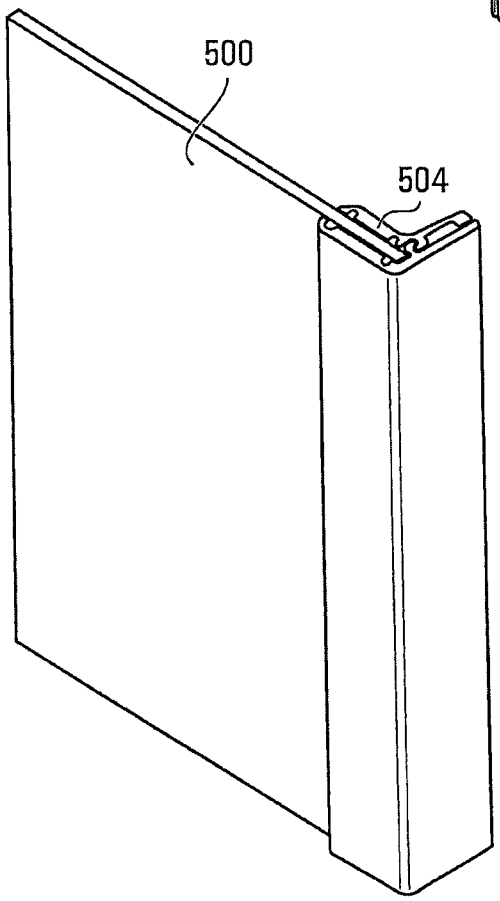
FIG. 6 is a perspective view of a glass panel and a clamping structure for mounting the glass panel to a wall, the perspective view being taken from the opposite side of the panel.
Figure 7:
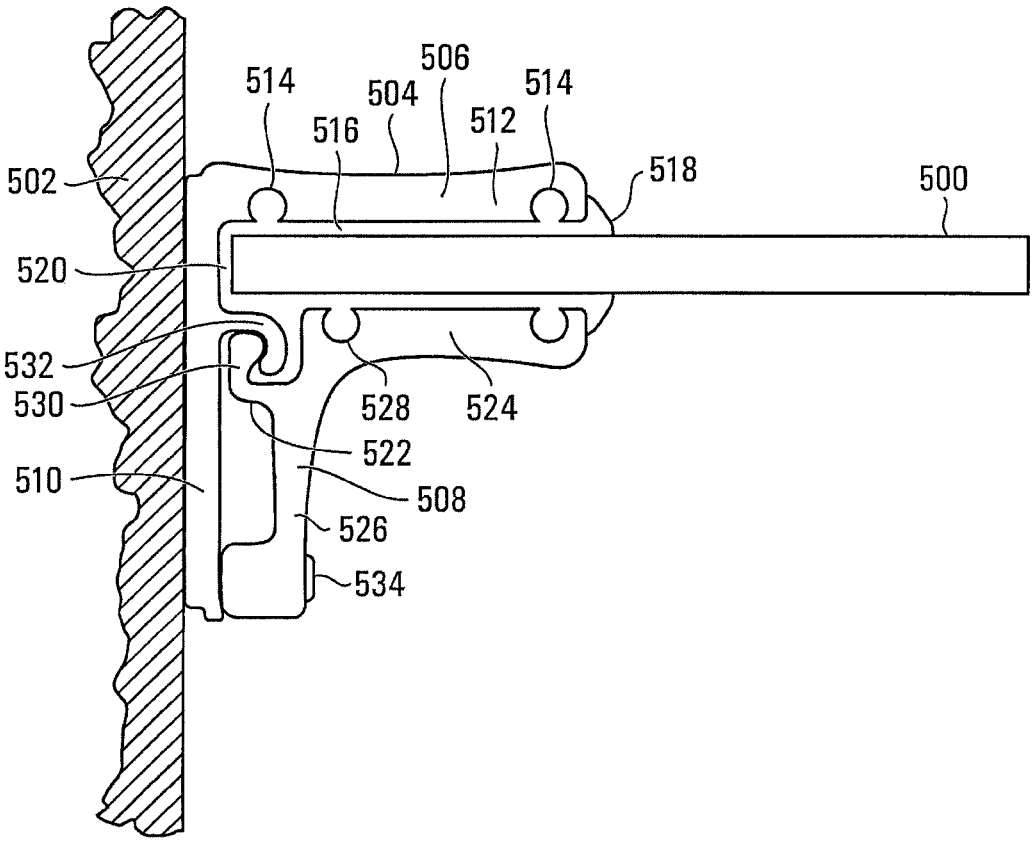
FIG. 7 is a horizontal cross sectional view of the clamping structure shown in FIGS. 5 and 6.

FIGS. 5, 6 and 7 illustrate a variant of the invention that relates to a clamping structure for mounting a glass panel or a panel of similar material to a wall. The clamping structure can be used in conjunction with the hinge described earlier or separately, without departing from the spirit of the invention.

The panel 500 which may be part of a shower installation or similar arrangement is attached to a wall structure 502. The panel 500 is usually intended to be mounted at right angle with relation to the plane of the wall 502.

In some instances, the wall 502 may not be perfectly vertical and in such case the edge of the panel 500 will not be exactly parallel to the wall 502. The clamping structure 504 provided to mount the glass panel 500 to the wall 502 is designed to accommodate such "out of plumb" situations while allowing to securely attach the glass panel 500 in place.

The clamping structure 504 is an extrusion having a generally constant cross-sectional shape along its length, made of aluminum or any other suitable material which has a base element 506 and a clamping element 508. The base element 506 is L-shaped and has a leg 510 that sits flat against the surface of the wall 502. The base element 506 also has a support leg 512 that is at right angles with respect to the leg 510 and is also transversal to the plane of the wall 502. On the inside surface of the leg 512 are provided a series of longitudinally extending grooves 514 in which is mounted a gasket 516 made of compliant material, such as rubber. The gasket 516 has a component 518 which extends along the leg 512 and component 520 that runs along the leg 510. The component 520 engages the edge of the glass panel 500 when the glass panel 500 is mounted to the clamping structure 504, while the component 518 engages one of the main faces of the glass panel 500.

The clamping element 508 is generally L-shaped and has a clamping leg 524 extending generally transversally to a support leg 526. The clamping leg 524 has a longitudinally extending recess in which is mounted a gasket 528, similar to the gasket 516. The gasket 528 engages the other main face of the glass panel 500 when the glass panel 500 is secured to the clamping structure 504.

The clamping element 508 is pivotally mounted to the base element 506 via a hinge arrangement 522. More specifically, the clamping element 508 includes a longitudinally extending projection 530 that constitutes a fulcrum. The projection 530 engages a hook-shaped longitudinally extending recess 532.

The projection 530 and the mating recess 532 thus form a hinge that allows the clamping element 508 to pivot about a generally vertical axis (which coincides with the longitudinal axis of the clamping structure) with relation to the base element 506. The degree of pivotal movement allowed is within a limited angular range but it permits to open sufficiently the spacing between the legs 524 and 512 to allow insertion of the glass panel 500 and then securely clamp the glass panel 500 in place. The pivotal movement also allows different glass panel thicknesses to be accommodated in the clamping structure 504.

The installation of the glass panel 500 to the wall 502 by using the clamping structure 504 starts by mounting the clamping structure 504 to the wall 502. This is achieved by placing the base element 506 against the wall 502 and securing the base element 506 by using any suitable fasteners. An example of a suitable method for securing the base element 506 is to drive screws at spaced apart locations through the leg 510, which engage a stud (not shown) in the wall 502.

The clamping element 508 is then mounted to the base element 506. This is achieved by inserting the projection 530 into the recess 532.

The glass panel 500 is then mounted to the clamping structure 504. This is done by inserting the vertical edge of the glass panel 500 between the clamping leg 524 and the leg 512. In cases when the wall 502 is not perfectly vertical, hence the surface of the wall is not strictly parallel to the vertical edge of the glass panel 500, the clamping structure will accommodate this fault while still holding the edge of the glass panel 500 securely. The extent to which an "out of plumb" imperfection can be accommodated is determined by the length of the legs 524 and 512. The deeper the glass panel edge penetrates into the clamping structure 504 the greater the compensation capability is.

When the glass panel edge is inserted into the clamping structure 504, the clamping element 508 is pressed against the glass panel 500. This is achieved by causing the clamping element 508 to pivot with respect to the base element 506 by the intermediary of the hinge arrangement 522. The pivotal movement is achieved by tightening a series of set screws 534 arranged longitudinally along the edge of the clamping element 508. The set screws 534 are threadedly mounted in the clamping element 508. As they are tightened, they project from the clamping element and engage the base leg 510 of the base element 506. This in turn drives the clamping element 50 to pivot counterclockwise, thus pressing it against the glass panel 500. The degree of pressure exerted against the glass panel 500 can be adjusted by varying the degree of tension applied to the set screws 534.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A hinge for movably connecting a first panel to a second panel, the hinge comprising:

first and second spaced apart hinge members, each hinge member being connectable to the respective first and second panels each hinge member having a front face placed against the respective first and second panels, wherein the front face is defined along a longitudinal direction and a latitudinal direction, perpendicular to the longitudinal direction, and the first and second panels have larger dimensions in the longitudinal and latitudinal directions than in a third direction, perpendicular to both the longitudinal and latitudinal directions; and a connector located between the hinge members, the connector having a pin member which connects the hinge members together to permit selective movement of the first panel relative to the second panel about multiple axes, wherein, the connector is aligned along a first axis, and the first hinge member has a track located therein to slidably receive the pin member to permit slidable movement of the first panel along a second axis, wherein the connector further includes a pin member bushing movably connected to the second hinge member, the pin member bushing including a sloped ramp surface to produce an upward displacement of the first panel as the first panel pivots into an open position, thereby disengaging the first panel from a floor of a shower stall;

wherein the pin member fits into the pin member bushing, the pin member being a mirror image of a recess in the pin member bushing; and wherein, with the first panel parallel to the second panel in the latitudinal direction and the front faces of the first and second hinge members facing the same direction, such that the first and second panels are in a closed position, the hinge is positioned such that the first panel is orientated such that a portion of the first panel overlaps a portion of the second panel.

2. The hinge, according to claim 1, in which the first axis is a vertical axis, the second axis being disposed perpendicular relative to the vertical axis, the first panel being moveable along the first axis.

3. The hinge, according to claim 1, in which the pin member includes:

an upper end portion sized and shaped for slidable movement in the track; and a lower end portion for location in the pin member bushing.

4. The hinge, according to claim 1, in which the second hinge member includes an end piece having a cavity located therein to receive the pin member bushing, the pin member bushing and a lower end portion of the pin member being arranged so as to permit hingeable movement of the first panel relative to the second panel.

5. The hinge, according to claim 4, in which the first axis is a vertical axis and the first panel being hingeable about the first axis.

6. The hinge, according to claim 3, in which a screw connects the upper end portion of the pin member to the track to permit advancement of the pin member along the track so as to vary the overlap between the two panels.

7. The hinge, according to claim 1, in which the second panel is fixed.

8. The hinge, according to claim 1 in which the pin member bushing includes a recess for receiving a pivot pin, the recess having a pair of projections that are diametrically opposed to one another, each projection having first, second and third functional surfaces.

9. The hinge, according to claim 8, in which the first surface is a top horizontal surface, the second surface is a vertical surface for abutting the pin, the third surface is a ramp surface located opposite the second surface, the third surface being sloped.

10. The hinge, according to claim 9, in which the pin member bushing includes an aperture for aligning the pin member.

11. A hinge for movably connecting a first panel to a second panel, the hinge comprising:

first and second spaced apart hinge members, each hinge member being connectable to the respective first and second panels each hinge member having a front face placed against the respective first and second panels, wherein the front face is defined along a longitudinal direction and a latitudinal direction, perpendicular to the longitudinal direction, and the first and second panels have larger dimensions in the longitudinal and latitudinal directions than in a third direction, perpendicular to both the longitudinal and latitudinal directions; and a connector located between the hinge members, the connector having a pin member which connects the hinge members together to permit selective movement of the first panel relative to the second panel about multiple axes, wherein, the connector is aligned along a first axis, and the first hinge member has a track located therein to slidably receive the pin member to permit slidable movement of the first panel along a second axis;

wherein the connector further includes a pin member bushing movably connected to the second hinge member, the pin member bushing including a sloped ramp surface to produce an upward displacement of the first panel as the first panel pivots into an open position, thereby disengaging the first panel from a floor of a shower stall;

wherein, with the first panel parallel to the second panel in the latitudinal direction and the front faces of the first and second hinge members facing the same direction, such that the first and second panels are in a closed position, the hinge is positioned such that the first panel is orientated such that a portion of the first panel overlaps a portion of the second panel;

wherein the pin member bushing includes a recess for receiving a pivot pin, the recess having a pair of projections that are diametrically opposed to one another, each projection having first second, and third functional surfaces, and further includes an aperture for aligning the pin member;

wherein the first surface is a top horizontal surface, the second surface is a vertical surface for abutting the pin, the third surface is a ramp surface located opposite the second surface, the third surface being sloped; and wherein the pin member includes a central cylindrical projection which fits snuggly into the aperture, the pin member having two generally opposite projections, the projections having a pair of top bearing surfaces, ramp surfaces and vertical abutment surfaces such that when the pin member is mounted in the pin member bushing, the projections on the pin member enter the recess of the pin member bushing and fit between the projections of the pin member bushing.

12. The hinge, according to claim 11, in which the top bearing surfaces engage the bottom of the recess of the pin member bushing, the projection being received in the aperture of the pin member bushing, thereby maintaining the first panel in a closed position.

13. The hinge, according to claim 11, in which the first panel pivots into an open position, the ramp surfaces slidingly engage each other and cause the pin member to rise out of the pin member bushing so as to produces an upward displacement of the first panel, thereby disengaging the first panel from a floor of a shower stall.

14. The hinge, according to claim 11, in which the movement between the pin member and the pin member bushing continues until the bearing surfaces engage the top surfaces to stop the upward motion, thereby permitting hingeable movement of the first panel relative to the second panel.

15. A hinge for movably connecting a first panel to a second panel, the hinge comprising:

first and second spaced apart hinge members, each hinge member being connectable to the respective first and second panels each hinge member having a front face placed against the respective first and second panels, wherein the front face is defined along a longitudinal direction and a latitudinal direction, perpendicular to the longitudinal direction, and the first and second panels have larger dimensions in the longitudinal and latitudinal directions than in a third direction, perpendicular to both the longitudinal and latitudinal directions; and a connector located between the hinge members, the connector having a pin member which connects the hinge members together to permit selective movement of the first panel relative to the second panel about multiple axes, wherein, the connector is aligned along a first axis, and the first hinge member has a track located therein to slidably receive the pin member to permit slidable movement of the first panel along a second axis;

wherein the connector further includes a pin member bushing movably connected to the second hinge member, the pin member bushing including a sloped ramp surface to produce an upward displacement of the first panel as the first panel pivots into an open position, thereby disengaging the first panel from a floor of a shower stall;

wherein, with the first panel parallel to the second panel in the latitudinal direction and the front faces of the first and second hinge members facing the same direction, such that the first and second panels are in a closed position, the hinge is positioned such that the first panel is orientated such that a portion of the first panel overlaps a portion of the second panel;

wherein the pin member bushing includes a recess for receiving a pivot pin, the recess having a pair of projections that are diametrically opposed to one another, each projection having first second, and third functional surfaces, and further includes an aperture for aligning the pin member;

wherein the first surface is a top horizontal surface, the second surface is a vertical surface for abutting the pin, the third surface is a ramp surface located opposite the second surface, the third surface being sloped; and wherein the pin member includes a central cylindrical projection which fits snuggly into the aperture, the pin member being a mirror image of a recess in the pin member bushing having two generally opposite projections, the projections having a pair of top bearing surfaces, ramp surfaces and vertical abutment surfaces such that when the pin member is mounted in the pin member bushing, the projections on the pin member enter the recess of the pin member bushing and fit between the projections of the pin member bushing.

* * * * *